US008020335B2

(12) United States Patent
Larsson et al.

(10) Patent No.: US 8,020,335 B2
(45) Date of Patent: Sep. 20, 2011

(54) MOUNT FOR MOUNTING ACCESSORIES ON A WEAPON

(75) Inventors: Niklas Larsson, Åkarp (SE); Magnus Petersen, Bara (SE)

(73) Assignee: GS Development AB, Malmo (SE)

( * ) Notice: Subject to any disclaimer, the term of this patent is extended or adjusted under 35 U.S.C. 154(b) by 557 days.

(21) Appl. No.: 11/662,569

(22) PCT Filed: Sep. 1, 2005

(86) PCT No.: PCT/SE2005/001256

§ 371 (c)(1),
(2), (4) Date: Mar. 17, 2009

(87) PCT Pub. No.: WO2006/041349

PCT Pub. Date: Apr. 20, 2006

(65) Prior Publication Data

US 2011/0030263 A1 Feb. 10, 2011

(30) Foreign Application Priority Data

Sep. 10, 2004 (SE) ..... 0402171

(51) Int. Cl.
*F41G 1/38* (2006.01)

(52) U.S. Cl. ..... 42/125; 42/90; 42/124; 42/127

(58) Field of Classification Search ..... 42/90, 124–128
See application file for complete search history.

(56) References Cited

U.S. PATENT DOCUMENTS

| | | | | |
|---|---|---|---|---|
| 2,583,260 | A * | 1/1952 | Felix | 42/126 |
| 2,649,779 | A * | 8/1953 | Hardgrove et al. | 42/127 |
| 3,559,940 | A * | 2/1971 | Kruzell | 42/127 |
| 3,672,623 | A * | 6/1972 | Jones | 248/229.1 |
| 4,341,022 | A * | 7/1982 | Santoro | 42/127 |
| 4,501,071 | A * | 2/1985 | Manske | 42/127 |
| 6,193,198 | B1 * | 2/2001 | Baur et al. | 248/222.41 |
| 6,598,333 | B1 * | 7/2003 | Randazzo et al. | 42/127 |
| 7,685,759 | B2 * | 3/2010 | Teetzel | 42/127 |
| D623,254 | S * | 9/2010 | Larsson | D22/108 |
| 7,823,316 | B2 * | 11/2010 | Storch et al. | 42/90 |
| 2004/0000083 | A1 * | 1/2004 | Grant, Jr. | 42/112 |
| 2008/0168696 | A1 * | 7/2008 | Orne et al. | 42/90 |
| 2009/0293334 | A1 * | 12/2009 | Swan | 42/90 |

FOREIGN PATENT DOCUMENTS

| | | | |
|---|---|---|---|
| DE | 580332 | C | 7/1933 |
| DE | 29802979 | U1 | 6/1998 |
| DE | 19709789 | C1 | 12/1998 |

* cited by examiner

*Primary Examiner* — Michael David
(74) *Attorney, Agent, or Firm* — Capitol City TechLaw

(57) ABSTRACT

A mount for mounting an accessory (19) on a weapon comprises a base plate (12) with an upper surface and a lower surface, to be connected with the accessory. The base plate (12) is clamped to a rail (10) on the weapon with the lower surface engaging the rail. Two aligned first grooves (23) in the upper surface extend in the longitudinal direction of the rail and a third groove (24) in the upper surface of the base plate, extends transversely of the first grooves. First protrusions (25) on the lower surface of the accessory guidingly engage the first grooves, and a third protrusion (26) on the lower surface of the accessory located between the first protrusions engages the third groove (24) to prevent displacement of the accessory along the first grooves.

7 Claims, 2 Drawing Sheets

MOUNT FOR MOUNTING ACCESSORIES ON A WEAPON

FIELD OF THE INVENTION

The present invention relates to a mount for mounting on a weapon an optical sight, a magnifier, a night vision device, or any other accessory of the weapon, comprising a base plate having an upper surface and a lower surface, to be connected with the accessory, and means for clamping the base plate to a rail on the weapon with the base plate extending in the longitudinal direction of the rail and with the lower surface engaging the rail.

BRIEF SUMMARY OF THE INVENTION

A primary object of the invention is to provide a mount of the kind referred to above which excludes play between the accessory and the weapon and thus maintains stability and accurate position of the accessory mounted to the weapon by means of the mount even at prolonged exposure to recoil forces generated at firing of the weapon.

A further object of the invention is to provide a mount of the kind referred to which allows accessories of different kinds to be mounted to weapons of different types and at different levels in order to align optical axes of the accessories along the weapon. For example, if an optical sight of the red dot type is mounted to the weapon a magnifier can easily be combined with the sight by mounting the magnifier to the weapon at such level that the optical axis of the magnifier is aligned with the optical axis of the sight.

These and other objects which will be apparent from the description which follows are achieved according to the invention by providing a mount of the kind referred to above which is characterized by two aligned first grooves in the upper surface of the base plate extending in the longitudinal direction of the rail when the accessory is mounted to the rail adjacent ends of the grooves being mutually spaced, a third groove in the upper surface of the base plate, extending transversely of said first grooves, first protrusions on the lower surface of the accessory guidingly engaging said first grooves, and a third protrusion on the lower surface of the accessory located between said first protrusions and engaging said third groove to prevent displacement of the accessory along said first grooves.

Further features of the invention are defined in the dependent claims.

BRIEF DESCRIPTION OF THE DRAWINGS

In the accompanying drawings

DETAILED DESCRIPTION OF THE INVENTION

The mount of the invention shall be connected to a weapon by means of a rail fastened to the weapon and extending in the longitudinal direction of the barrel of the weapon. The rail can be a Picatinny rail (military arms) or a Weaver rail (hunting arms) and includes a uniform array of transverse notches. A cross bar on the mount is engaged with one of these notches at the desired position on the rail.

Figure 1:
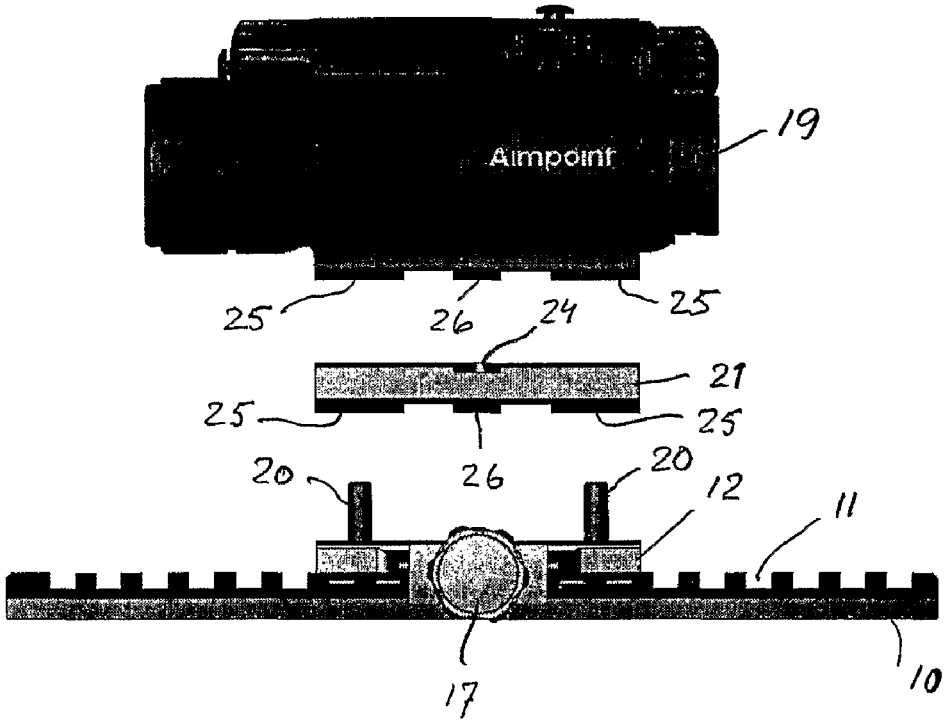
FIG. 1 is an exploded perspective view of a mount of the invention and shows a rail to which the mount is connected, a spacer plate and a sight.
Figure 2:
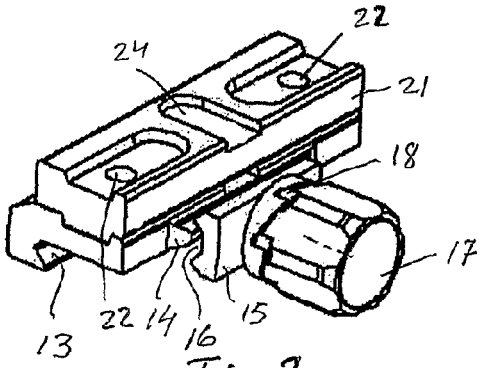
FIG. 2 is a perspective view of the mount as seen from the front side thereof.
Figure 3:
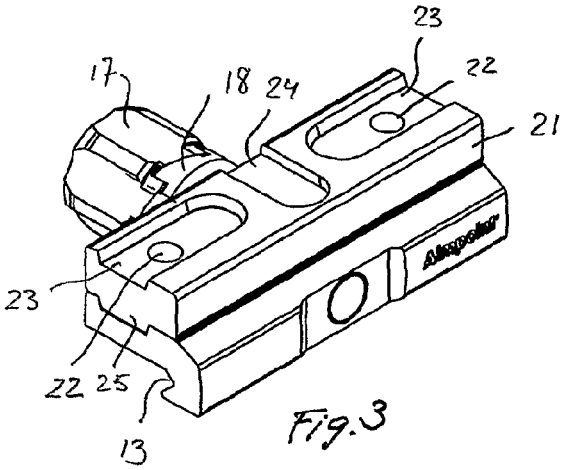
FIG. 3 is a perspective view of the mount as seen from the back side thereof.

FIG. 1 discloses such a rail at 10 having notches 11, and the mount comprises a base plate 12 on the lower surface of which said crossbar is provided although not shown in the drawings. The base plate forms an undercut groove 13 along one longitudinal edge thereof to be engaged with the rail, and a longitudinal rib 14 along the opposite longitudinal edge thereof (FIGS. 2 and 3). A jaw 15 forms a groove 16 to receive rib 14 therein and is connected to the base plate by means of a screw the thread of which engages a threaded blind hole in the base plate. A knob 17 is connected with the screw over a ratchet clutch 18 allowing the screw to be rotated manually in order to clamp the base plate on the rail the base plate engaging the rail in groove 13 and jaw 15 engaging the rail at groove 16. Ratchet clutch 18 will disconnect the screw from knob 17 if the torque applied to the knob exceeds a predetermined value.

Base plate 12 is connected with an accessory such as a red dot sight 19 or any other accessory to be mounted on the weapon by means of the mount. The connection is effected by means of screws 20 having heads countersunk in the lower surface of base plate 12 and extending with clearance through apertures in the base plate. The screws are screwed into threaded bottom holes in the lower surface of sight 19 and secure the sight to the base plate either with the lower surface of the sight engaging the upper surface of the base plate or alternatively with the lower surface of the sight engaging the upper surface of a spacer plate 21, FIG. 1, the lower surface of which engages the upper surface of the base plate, screws 20 passing with clearance through apertures in the spacer plate.

Figure 4:
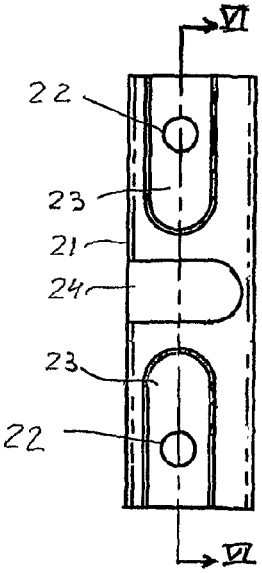
FIG. 4 is a plan view of the spacer plate as seen from the upper side thereof.
Figure 5:
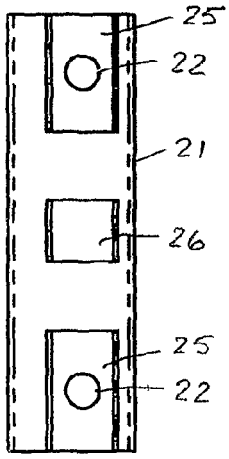
FIG. 5 is a plan view of the spacer plate as seen from the lower side thereof.
Figure 6:
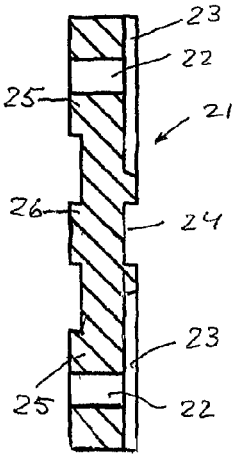
FIG. 6 is a sectional view of the spacer plate taken along line VI-VI in FIG. 4.

The mount is disclosed in combination with the spacer plate in FIGS. 2 and 3, and the spacer plate alone is disclosed in FIGS. 4 to 6.

The spacer plate forms two circular apertures 22 for screws 20. The upper surface of the spacer plate, shown in FIG. 4, is a plane surface with two aligned grooves 23 which are milled from opposite ends of the spacer plate and extend in the longitudinal direction thereof. The side surfaces of the grooves are inclined at an angle of e.g. about 20° to the vertical. Adjacent ends of the grooves are mutually spaced, and in the space between the ends a groove 24 extends transversely of grooves 23: This transverse groove is milled in the upper surface of the spacer plate from one of the longitudinal edges of the spacer plate.

It should be noted that the upper surface of base plate 12 shall have grooves arranged in the same manner as described with reference to the spacer plate. In other words, the design of the upper surface of the base plate shall be identical with the design of the upper surface of the spacer plate.

Figure 7:
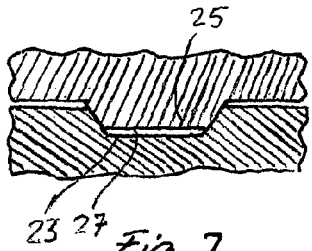
FIG. 7 is an enlarged fragmentary cross sectional view illustrating the interengagement between a base plate and the spacer plate of the mount.

The lower surface of spacer plate 21, shown in FIG. 5, is plane and forms three aligned protrusions 25, 25 and 26. The side surfaces of protrusions 25 extending in the longitudinal direction of the spacer plate are inclined and form an angle of e.g. about 20° to the vertical. The lower surface of the sight or any accessory to be mounted to the weapon shall have protrusions arranged as described with reference to the spacer plate. Thus, the lower surface of any accessory should be identical with the lower surface of the spacer plate. Protrusions 25 each fit into one of grooves 23 when a lower surface of a spacer plate or an accessory is engaged with the upper surface of the base plate or the spacer plate. However, protrusions 25 are slightly wider than the matching grooves 23; the difference in width at the bottom surface of the protrusion and the groove, respectively, is of the order of e.g. 0.1 mm. As a consequence thereof the accessory or the spacer plate, respectively, will engage at the inclined side surfaces and thus will be supported by said surfaces leaving a space 27 between the flat bottom surface of the groove and the flat bottom surface of the protrusion received therein as disclosed in FIG. 7. By this arrangement the accessory is mounted to the weapon without play so that the position of the sight dot of a sight mounted to the weapon cannot change at firing. Moreover, the tolerance requirements for grooves and protrusions can be reduced.

Protrusion 26 engaging groove 24 forms a recoil stop taking up the recoil forces generated during firing of the weapon. No radial forces will act on screws 20 and deformation of these screws and apertures 22 will be prevented.

The mount can be used for mounting an accessory directly to the base plate of the mount, or for mounting an accessory with one or more spacer plates or described inserted between the accessory and the base plate of the mount in order to bring the accessory to a level required e. g. for aligning an optical axis of the accessory with an optical axis of another accessory attached to the same rail on the weapon. The possibility of inserting spacer plates of different thickness to provide such axial lineup also allows adjustment of the mounting so as to adapt the mounting to weapons of different types.

The invention claimed is:

1. A mount for mounting on a weapon an optical sight, a magnifier, a night vision device or any other accessory of the weapon, the mount comprising:

a base plate having an upper surface and a lower surface;

a jaw coupled to the base plate, the jaw configured to clamp the base plate to a rail on the weapon, such that the lower surface of the base plate engages the rail;

two aligned first grooves provided in the upper surface of the base plate, the first grooves being spaced apart, the first grooves extending in the longitudinal direction of the rail when the accessory is mounted to the rail, and the first grooves being configured to guidingly engage first protrusions on a lower surface of the accessory; and a third groove provided in the upper surface of the base plate, the third groove extending transversely of the first grooves, and the third groove being configured to engage a third protrusion on the lower surface of the accessory located between the first protrusions to prevent displacement of the accessory along the first grooves.

2. The mount as defined in claim 1, wherein the first grooves each have a plane bottom surface and inclined side surfaces joining the bottom surface; and wherein the inclined side surfaces are configured to support the accessory, such that a gap exists between bottom surfaces of the first protrusions and the bottom surfaces of the first grooves.

3. The mount as defined in claim 1, wherein a spacer plate having an upper surface and a lower surface is mounted on the base plate; and wherein grooves identical to the first grooves are provided in the upper surface of the spacer plate and protrusions identical to the first and the third protrusions are provided on the lower surface of the spacer plate.

4. A mount for mounting an accessory on a weapon, the mount comprising:

a base plate having an upper surface and a lower surface;

a jaw coupled to the base plate for movement relative to the base plate in a first direction;

two aligned first grooves provided in the upper surface of the base plate, the first grooves extending in a second direction that is perpendicular to the first direction, and the first grooves being configured to guidingly engage the accessory; and a third groove provided in the upper surface of the base plate, the third groove extending in the first direction and located between the first grooves, and the third groove being configured to engage the accessory to prevent displacement of the accessory along the first grooves.

5. A combination of an accessory mounted to a mount on a weapon, the combination comprising:

a base plate having an upper surface and a lower surface;

a jaw coupled to the base plate, the jaw clamping the base plate to a rail on the weapon with the base plate extending in the longitudinal direction of the rail and with the lower surface of the base plate engaging the rail;

two aligned first grooves provided in the upper surface of the base plate, the first grooves being spaced apart, the first grooves extending in the longitudinal direction of the rail, and the first grooves guidingly engaging first protrusions on a lower surface of the accessory; and a third groove provided in the upper surface of the base plate, the third groove extending transversely of the first grooves, and the third groove engaging a third protrusion on the lower surface of the accessory located between the first protrusions to prevent displacement of the accessory along the first grooves.

6. The mount as defined in claim 5, wherein the first grooves each have a plane bottom surface and inclined side surfaces joining the bottom surface;

wherein the first protrusions each have a plane bottom surface and inclined side surfaces joining the bottom surface and engaging the inclined side surfaces of the first grooves; and wherein the accessory is supported on the base plate at the inclined side surfaces leaving a gap between the bottom surfaces of the first protrusions and the bottom surfaces of the first grooves.

7. The mount as defined in claim 5, wherein a spacer plate having an upper surface and a lower surface is located between the base plate and the accessory; and wherein grooves identical to the first grooves are provided in the upper surface of the spacer plate and protrusions identical to the first and the third protrusions are provided on the lower surface of the spacer plate.

* * * * *